US010674291B2

(12) United States Patent
Beyfuss et al.

(10) Patent No.: US 10,674,291 B2
(45) Date of Patent: Jun. 2, 2020

(54) HEARING DEVICE AND CONNECTING CLIP FOR A HEARING DEVICE

(71) Applicant: SIVANTOS PTE. LTD., Singapore (SG)

(72) Inventors: Stefanie Beyfuss, Erlangen (DE); Volker Goly, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 16/014,227

(22) Filed: Jun. 21, 2018

(65) Prior Publication Data

US 2018/0376259 A1 Dec. 27, 2018

(30) Foreign Application Priority Data

Jun. 21, 2017 (DE) ..... 10 2017 210 448

(51) Int. Cl.
*H04R 25/00* (2006.01)
*H01Q 1/27* (2006.01)

(52) U.S. Cl.
CPC ..... *H04R 25/60* (2013.01); *H01Q 1/273* (2013.01); *H04R 25/658* (2013.01); *H04R 2225/51* (2013.01)

(58) Field of Classification Search
CPC ..... H04R 25/60; H04R 25/608; H04R 25/00; H04R 25/658; H04R 2225/51; G06F 1/16; H01Q 1/273
USPC ..... 381/315, 322, 323, 358
See application file for complete search history.

(56) References Cited

U.S. PATENT DOCUMENTS

| | | | | |
|---|---|---|---|---|
| 8,542,858 | B2 * | 9/2013 | Flaig | H04R 25/65 381/358 |
| 8,644,543 | B2 * | 2/2014 | Lederer | H04R 25/456 381/322 |
| 9,467,788 | B2 | 10/2016 | Lommel et al. | |
| 9,571,944 | B2 | 2/2017 | Fischer et al. | |
| 10,031,551 | B2 * | 7/2018 | Seo | G06F 1/163 |
| 2003/0221902 | A1 | 12/2003 | Stinauer et al. | |

(Continued)

FOREIGN PATENT DOCUMENTS

| | | | |
|---|---|---|---|
| DE | 4035506 | A1 | 5/1992 |
| DE | 102007010014 | A1 | 9/2008 |

(Continued)

*Primary Examiner* — Gerald Gauthier
(74) *Attorney, Agent, or Firm* — Laurence A. Greenberg; Werner H. Stemer; Ralph E. Locher

(57) ABSTRACT

A hearing device includes a frame for insertion into a housing and for retaining hearing device components. The frame includes two frame parts being joined together or to be joined together, substantially along a partition plane and being mechanically interconnected or to be mechanically interconnected by a connecting clip. In a first variant, the connecting clip has two spaced apart and parallel pins engaging into corresponding recesses in the respective frame parts for holding the frame parts together by form-locking engagement transversely to the partition plane. In a second variant, each frame part has a pin engaging into a respective corresponding recess in the connecting clip for holding the frame parts together by form-locking engagement transversely to the partition plane. This permits the frame to be produced particularly efficiently. A connecting clip for a hearing device is also provided.

17 Claims, 3 Drawing Sheets

(56) References Cited

U.S. PATENT DOCUMENTS

| | | | | |
|---|---|---|---|---|
| 2004/0196996 | A1* | 10/2004 | Feitel | H04R 25/65 381/322 |
| 2005/0238192 | A1* | 10/2005 | Ford | H04R 25/654 381/322 |
| 2006/0034474 | A1* | 2/2006 | Topholm | H04R 25/556 381/322 |
| 2007/0071265 | A1 | 3/2007 | Leedom et al. | |
| 2008/0212817 | A1* | 9/2008 | Lommel | H04R 25/60 381/323 |
| 2009/0202092 | A1* | 8/2009 | Ruppert | H01M 2/1044 381/323 |
| 2011/0170722 | A1* | 7/2011 | Brimhall | H04R 25/60 381/322 |
| 2015/0281859 | A1* | 10/2015 | Fischer | H01Q 1/273 381/315 |
| 2016/0227334 | A1* | 8/2016 | Johansen | H04R 25/65 |
| 2018/0376259 | A1* | 12/2018 | Beyfuss | H04R 25/658 |

FOREIGN PATENT DOCUMENTS

| | | | | |
|---|---|---|---|---|
| EP | 1439733 | B1 * | 1/2011 | H04R 1/12 |
| JP | H02224599 | A | 9/1990 | |
| WO | 2014090419 | A1 | 6/2013 | |

* cited by examiner

HEARING DEVICE AND CONNECTING CLIP FOR A HEARING DEVICE

CROSS-REFERENCE TO RELATED APPLICATION

This application claims the priority, under 35 U.S.C. § 119, of German Patent Application DE 10 2017 210 448.1, filed Jun. 21, 2017; the prior application is herewith incorporated by reference in its entirety.

BACKGROUND OF THE INVENTION

Field of the Invention

The invention relates to a hearing device with a housing and a frame which is insertable into the housing and serves to retain hearing device components. The invention also relates to a connecting clip for a hearing device.

A hearing device serves to supply a hearing-impaired person with acoustic signals from the surroundings. The acoustic signals are suitably processed, in order to compensate for the specific hearing impairment, and in particular the acoustic signals are amplified. To that end, a hearing device usually includes an input transducer, for example in the form of a microphone, a signal processing unit with an amplifier, and an output transducer. The output transducer is generally realized as a miniaturized loudspeaker and is also referred to as a receiver. The output transducer in particular generates acoustic output signals which are fed to the auditory system of the patient and provide the patient with the desired auditory perception.

Different constructions of hearing devices are offered in order to meet the great many individual requirements. In the case of BTE (behind-the-ear) hearing devices, a housing that contains components such as a battery and the signal processing unit is worn behind the ear. Depending on the construction, the receiver can be disposed directly in the auditory canal of the wearer (receiver-in-canal (RIC) hearing devices) or, alternatively, the receiver can be disposed inside the housing itself and a flexible sound tube can guide the acoustic output signals of the receiver from the housing to the auditory canal. In the case of ITE (in-the-ear) hearing devices, a housing that contains all of the functional components, including the microphone and the receiver, is worn at least partly in the auditory canal. CIC (completely-in-canal) hearing devices are similar to the ITE hearing devices but are worn completely in the auditory canal.

In a conventional construction, a behind-the-ear hearing device includes, for example, a housing shell which is worn behind the ear of a user and which is often formed from two half-shells, wherein the housing shell accommodates a frame, which retains the hearing device components. In that way, the hearing device components can be inserted fully into the housing shell. A hearing device with such a housing shell and with a frame is known from German Patent DE 10 2007 010 014 B4, corresponding to U.S. Pat. No. 9,467,788, for example. The frame of the latter is divided in the longitudinal direction into two approximately planar frame parts, wherein the hearing device components are disposed and retained substantially between the two frame parts. In a further development of such a frame according to International Publication WO 2014/090419 A1, corresponding to U.S. Pat. No. 9,571,944, an antenna for transmitting electromagnetic waves is integrated in the form of an electrically conductive structure into the frame.

SUMMARY OF THE INVENTION

It is accordingly an object of the invention to provide a hearing device and a connecting clip for a hearing device, which overcome the hereinafore-mentioned disadvantages of the heretofore-known devices of this general type and which provide a hearing device with a frame which is received in a housing shell and serves to retain hearing device components and in which the frame can be produced particularly efficiently.

With the foregoing and other objects in view there is provided, in accordance with the invention, a hearing device including a housing, and a frame which is insertable into the housing and which serves to retain hearing device components, the frame including two frame parts which can be joined together, or are joined together, substantially along a partition plane and which can be connected mechanically to each other, or are connected mechanically to each other, with the aid of a connecting clip, the connecting clip having two pins which are disposed at a distance from each other and parallel to each other and which engage in two corresponding recesses in the respective frame parts, in such a way that the two frame parts are held together by form-locking engagement transversely with respect to the partition plane.

With the objects of the invention in view, there is also provided a hearing device including a housing, and a frame which is insertable into the housing and which serves to retain hearing device components, the frame including two frame parts which can be joined together, or are joined together, substantially along a partition plane and which can be connected mechanically to each other, or are connected mechanically to each other, with the aid of a connecting clip, each frame part having a respective pin, and the two pins engaging in corresponding recesses in the connecting clip, in such a way that the two frame parts are held together by form-locking engagement transversely with respect to the partition plane.

The hearing device according to the invention includes a housing shell, and a frame which is insertable into the housing shell and which serves to retain hearing device components, in particular to retain a microphone, and a signal processor and an amplifier. The frame includes two frame parts which, in a customary manner, can be joined together, or are joined together, substantially along a partition plane. A "partition plane" designates an imaginary plane lying between the two frame parts, in such a way that one frame part lies largely on one side of the partition plane, while the other frame part lies largely on the other side of the partition plane. The term "substantially" alludes to the fact that it is also within the scope of the invention that two connecting edges of the two frame parts do not lie or do not completely lie in the partition plane. In the state when joined together, individual portions of a frame part can therefore also protrude past the (imaginary) partition plane. According to the invention, the two frame parts can be connected mechanically to each other, or are connected mechanically to each other, with the aid of a connecting clip. The expression "connected mechanically to each other" signifies that the connection between the two frame parts and also the connection of the connecting clip to the two frame parts can be released without destruction. The connecting clip is in particular a structural part that is separate (i.e. detached) from the two frame parts.

In a first variant of the invention, the connecting clip includes two pins (also known as "stubs") which are spaced apart from each other and disposed parallel to each other. In the intended state of use, i.e. in the correctly assembled state of the two frame parts and of the connecting clip, the two pins engage in two corresponding recesses (also referred to as "depressions") in the respective frame parts, wherein one recess is disposed in one frame part, while the other recess is disposed in the other frame part. In this way, the two pins engage, in the manner of a clip, around two portions of the respective frame parts lying between the two pins, in such a way that the two portions, and thus the two frame parts as a whole, are held together by form-locking engagement transversely with respect to the partition plane. The expression "form-locking engagement" signifies that the two pins for the two frame parts each form an outer abutment, which prevents the two frame parts from being able to move apart from each other in a direction transverse to the partition plane.

In a second variant of the invention, provision is made for a pin to protrude from each frame part, wherein the respective pins of the two frame parts engage in corresponding recesses in the connecting clip, in such a way that the two frame parts are again held together by form-locking engagement transversely with respect to the partition plane.

The invention is based on the recognition that, due to the hearing device components held in the frame, in particular due to a battery inserted between the two frame parts, a force acts on the two frame parts and presses the two frame parts away from each other counter to their direction of assembly. This force is exactly orthogonal or at least approximately orthogonal to the partition plane along which the two frame parts are joined together.

The connecting clip according to the invention advantageously counters this force in a simple but effective manner, through the clamping action of the two pins (in the first variant of the invention) or through the clamping force of the recesses (in the second variant of the invention), in such a way that the frame parts are advantageously connected to each other reliably and in a particularly stable manner. Moreover, the connecting clip is very easy to fit and therefore represents a straightforward solution to improving the mountability and stability of the frame. Moreover, the connecting clip is relatively easy to dismantle, in such a way that the frame can advantageously be opened easily, and in particular without destruction, to allow maintenance or repair of the hearing device components retained in it.

In an advantageously particularly compact embodiment, the connecting clip preferably includes a back, which is configured as a flat shaped part and from which the two pins protrude at a flat side. In order to further support the space-saving embodiment, the connecting clip (and therefore also optionally the above-described back) preferably lies, in its mounted state, in a seat which is formed in both frame parts and which is shaped to complement the connecting clip. In particular, the connecting clip lies completely in the seat, i.e. it does not protrude beyond a surface surrounding the seat. The connecting clip is thus set back into both frame parts and therefore advantageously requires no additional installation space.

In a preferred embodiment, the connecting clip includes a grip which, in the course of the mounting of the connecting clip, can be separated at a predetermined breaking point provided for this purpose. In this embodiment, the connecting clip is firstly inserted with the two pins into the recesses provided for this purpose. The grip is then separated at the predetermined breaking point. In this embodiment, the connecting clip advantageously combines ease of handling during fitting with a small installation space in the assembled state.

The pins or stubs, and the corresponding recesses, are preferably round in cross section. However, other cross-sectional shapes are also conceivable. In particular, the pins or stubs lie with a precision fit in the associated recesses. The pins or stubs are preferably received completely in the respectively associated recesses.

The connecting clip is particularly preferably produced from plastic. In this way, the connecting clip can advantageously be produced relatively cost-effectively and can thus be readily replaced if lost or broken. Moreover, plastic advantageously causes no interference in the case of wireless data transmission, as is most often used in hearing devices. The connecting clip is thus advantageous over screws which are often used to connect the frame parts and which are typically made of metal.

In a development of the invention, at least one of the two frame parts is produced, preferably both frame parts are produced, with an integrated conductor structure, wherein the or each frame part is in particular produced as an MID part (molded interconnect device, or injection-molded circuit carrier).

The connecting technique according to the invention proves particularly advantageous for a frame provided with a conductor structure: Through the use of the integrated conductor structure, in particular through the use of the MID technology, the frame is more expensive to produce as compared to conventional frames without an integrated conductor structure, and therefore non-destructive dismantling of the frame for maintenance and repair purposes is particularly important. The material used for producing the connecting clip, in particular the plastic used for this purpose, expediently has more favorable mechanical properties than a plastic with integrated electronics. It is therefore particularly advantageous that the mechanical load to be taken up in the transverse direction is taken up principally by the (mechanically more stable) connecting clip. Since the connecting clip is a part separate from the two frame parts, it is particularly advantageous that a material that differs from the frame material can be chosen to produce the connecting clip. This is particularly so in the case of a frame having an integrated conductor structure.

An RF (radio frequency) antenna is preferably integrated in at least one of the frame parts, preferably in both frame parts. The RF antenna is preferably configured as a conductor structure integrated in the at least one frame part. The RF antenna serves to transmit radio signals that are transmitted in particular at a frequency of 2.4 GHz (as is typically used in the Bluetooth standard).

The connecting clip preferably includes two pins with a space disposed between them. However, it is also possible, within the context of the invention, that the connecting clip has several pins (and accordingly several spaces). Moreover, the two frame parts of the frame can also be fixed to each other with the aid of several connecting clips. In addition, the frame can also be formed from more than two frame parts, in each case with the aid of associated connecting clips.

Other features which are considered as characteristic for the invention are set forth in the appended claims.

Although the invention is illustrated and described herein as embodied in a hearing device and a connecting clip for a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
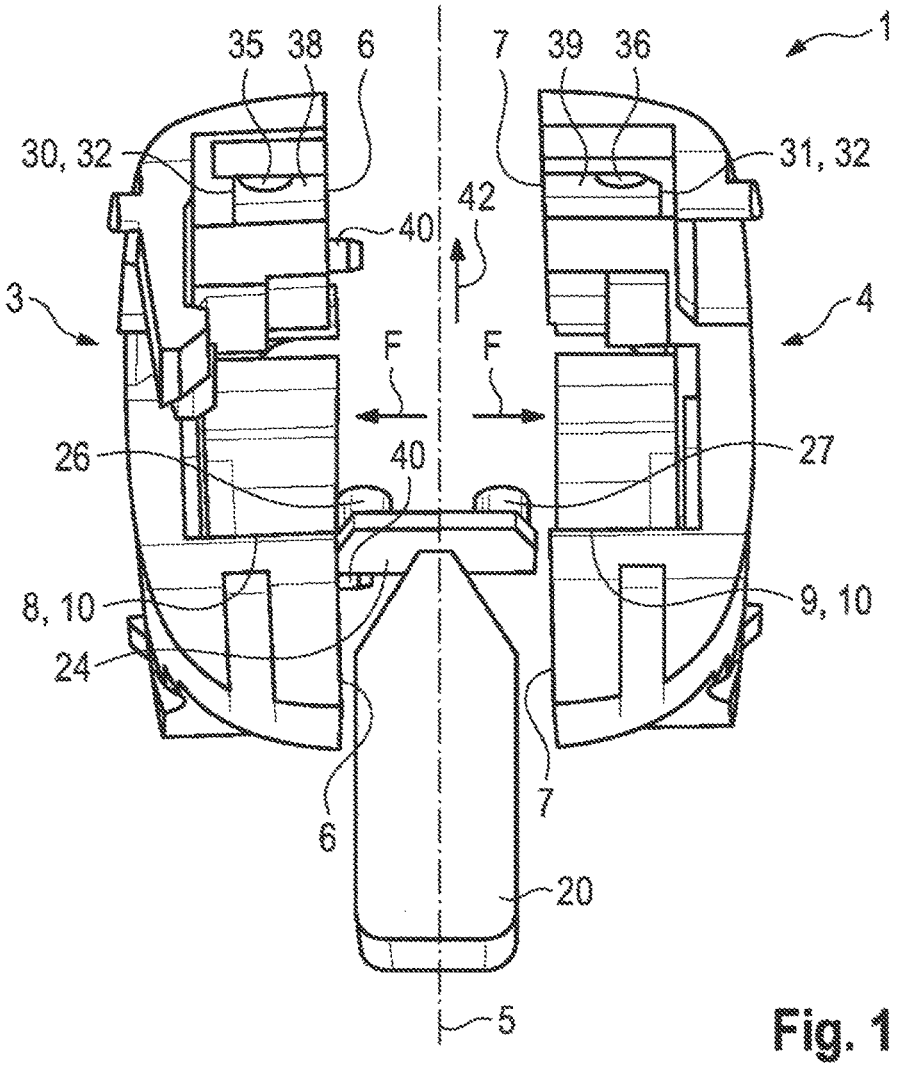
FIG. 1 is a diagrammatic, exploded, perspective view of a frame which is insertable into a hearing device shell and which includes two frame parts that are connected mechanically to each other by a connecting clip.

Referring now in detail to the figures of the drawings, in which parts and sizes corresponding to each other are always provided with the same reference signs and first, particularly, to FIG. 1 thereof, there is seen a frame 1 of a hearing device, in which the frame is insertable in a conventional manner into a non-illustrated housing of the hearing device. The hearing device is in particular a behind-the-ear device, in which the housing is worn behind the ear of a user. For example, the hearing device is constructed as an RIC (receiver-in-canal) device, in which a receiver or miniature loudspeaker of the hearing device is disposed in the auditory canal of the user.

The frame 1 serves to hold the hearing device components typically received in the housing, e.g. microphones and signal processor, in such a way that these components are received in a fixed position relative to each other in the housing. The received hearing device components are not shown herein for simplification.

Such a frame for retaining hearing device components is known in principle from German Patent DE 10 2007 010 014 B4, corresponding to U.S. Pat. No. 9,467,788, or from International Publication WO 2014/090419 A1, corresponding to U.S. Pat. No. 9,571,944, and therefore the structure of the frame 1 is discussed only insofar as it concerns the invention.

The frame 1 includes a first frame part 3 as well as a second frame part 4, in which both frame parts 3, 4 are configured as shaped parts approximately like a half shell which can be joined together along a partition line 5 (approximately perpendicular to the drawing plane in the view chosen herein) to form the frame 1. The two frame parts 3, 4 abut each other through corresponding connecting edges 6, 7 which, in the embodiment shown, lie at least approximately in the (imaginary) partition plane 5.

In the illustrative embodiment, the two frame parts 3, 4 are each produced as an MID part (molded interconnect devices (MID)), i.e. the two frame parts 3, 4 are constructed as injection-molded circuit carriers. Accordingly, an electrical conductor structure is integrated into the frame parts 3, 4 in the course of the production of the latter. The electrical conductor structure forms an RF antenna, which is set up to transmit radio signals according to the Bluetooth standard. The RF antenna is thus set up and configured to transmit radio signals at a frequency of 2.4 GHz.

The remaining hearing device components held by the frame 1 are held substantially between the two frame parts 3, 4 and are protected by them. As can be seen from the figure, two mutually opposite cutouts 8, 9 in the two frame parts 3, 4 combine to form a battery seat 10 in the assembled state of the two frame parts 3, 4.

The non-illustrated battery, which is inserted as intended into the battery seat 10, is disposed so as to lie approximately in the partition plane 5. The inserted battery has a tendency to spread the frame parts 3, 4 apart from reach other in a direction lying approximately transverse to the partition plane 5. In other words, the battery placed under mechanical stress applies a transverse force F (also lateral force), indicated by an arrow, on the two frame parts 3, 4. That force is oriented approximately perpendicularly with respect to the partition plane 5.

Figure 2:
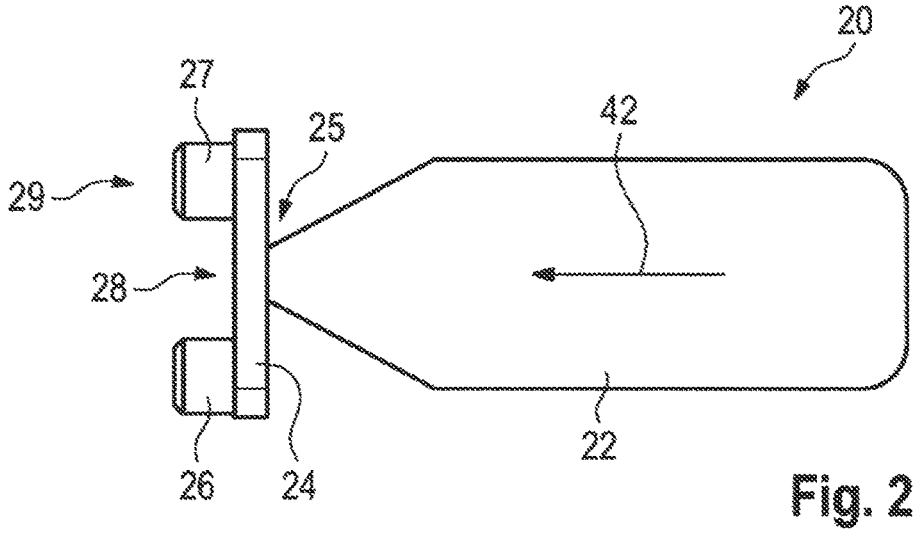
FIG. 2 is a perspective view of the connecting clip of FIG. 1 on its own.

In order to counteract the transverse force F, a connecting clip 20 shown in detail in FIG. 2 is used to connect the two frame parts 3, 4. The connecting clip 20 is produced as a shaped part from plastic. The connecting clip 20 is thus produced from a material that is sufficiently rigid to take up the transverse force F.

As is shown in FIG. 2, the connecting clip 20 includes an elongate grip 22 (for example having a planar extent in this case) having a first longitudinal end at which a likewise elongate, planar (but overall smaller) back 24 is integrally formed. The grip 22 and the back 24 are oriented approximately orthogonally with respect to each other in their area extent. The grip 22 runs to a point in the direction of its first longitudinal end, in such a way that a predetermined breaking point 25 is formed by this tapering between the grip 22 and the back 24.

The back 24 has, for example, an approximately rectangular shape, in which two corners (lying at the top in the figure) are beveled. Two short cylindrical pins 26, 27 (also known as "plug heads") protrude at both longitudinal ends from the flat side of the back 24 which is directed away from the grip 22. In terms of their axes, the two pins 26, 27 are oriented parallel to each other in the longitudinal extent of the connecting clip 20 and lie in a plane with the grip 22. The pins 26, 27 are chamfered at the edges at their respective free ends. A free space 28 is formed between the two pins 26, 27. A side on which the two pins 26, 27 are disposed is designated as a front face 29 of the connecting clip 20.

Corresponding recesses 30, 31 are formed in the two frame parts 3, 4 for mounting the connecting clip 20. As can be seen from FIG. 1, both recesses 30, 31 lie in an inner face of the respective frame part 3, 4 which is oriented approximately perpendicular to the partition plane 5. In the assembled state of the two frame parts 3, 4, the two recesses 30, 31 supplement each other to form a clip seat 32, which has a shape complementing the outer contour of the front of the connecting clip 20. Correspondingly, the recesses 30, 31 and the assembled clip seat 32 have a shape that is configured as a negative form of the back 24, including the integrally formed pins 26, 27. Accordingly, each recess 30, 31 has a circular depression 35, 36 and the two depressions 35, 36 are adapted in terms of their configuration and size to the two pins 26, 27. A respective axis of each depression 35, 36 is in each case parallel to the partition plane 5 so that the two axes (in the assembled state of the two frame parts 3, 4) are oriented parallel to each other. In the assembled state of the two frame parts 3, 4, a first holding portion 38 of the first frame part 3 and a second holding portion 39 of the second frame part 4 abut each other in the region of the clip seat 32. Both holding portions 38, 39 are formed by the material of the respectively associated frame part 3, 4 lying between the two depressions 35, 36 and the respectively assigned connecting edge 6, 7.

In order to mount the frame 1, the first frame part 3 additionally has two positioning pins 40, in the customary manner, which protrude from the frame part 3 approximately perpendicularly with respect to the area extent of the frame part 3 (i.e. also approximately perpendicular to the partition plane 5) and engage in corresponding openings (not shown herein) on the other frame part 4, in such a way that the two frame parts 3, 4 in the assembled state are oriented in a fixed position relative to each other along the partition plane 5.

The mounting of the frame 1 proceeds in the manner described below. As is indicated in FIG. 1, the two frame parts 3, 4 are first of all joined together with the aid of the positioning pins 40, in such a way that the corresponding connecting edges 6, 7 of the two frame parts 3, 4 abut each other approximately in the partition plane 5.

Thereafter, the connecting clip 20 is mounted along a mounting direction 42 indicated by an arrow (which direction is oriented parallel to the longitudinal extent of the two pins 26, 27, and parallel to the respective axis of the depressions 35, 36), so that the front face 29 of the connecting clip 20 is inserted with a precision fit into the clip seat 32 that is provided for this purpose. The two pins 26, 27 are plugged more or less simultaneously into the two assigned depressions 35, 36, in such a way that the two holding portions 38, 39 come to lie in a space 28 of the connecting clip 20. The pins 26, 27 act, in each case in the direction of the transverse force F, as an external limit stop for the two holding portions 38, 39. In particular, the pins 26, 27 are constructed to hold the holding portions 38, 39 on each other by exerting a certain clamping force (i.e. with pretensioning). The connecting clip 20 is held securely in the clip seat 32 by a static friction acting between connecting clip 20 and clip seat 32. In the inserted state, the rear face of the back 24 terminates flush with the inner face surrounding the clip seat 32.

After the connecting clip 20 has been inserted into the clip seat 32, the grip 22 is separated and removed from the back 24 by twisting or bending it at the predetermined breaking point 25.

Figure 3:
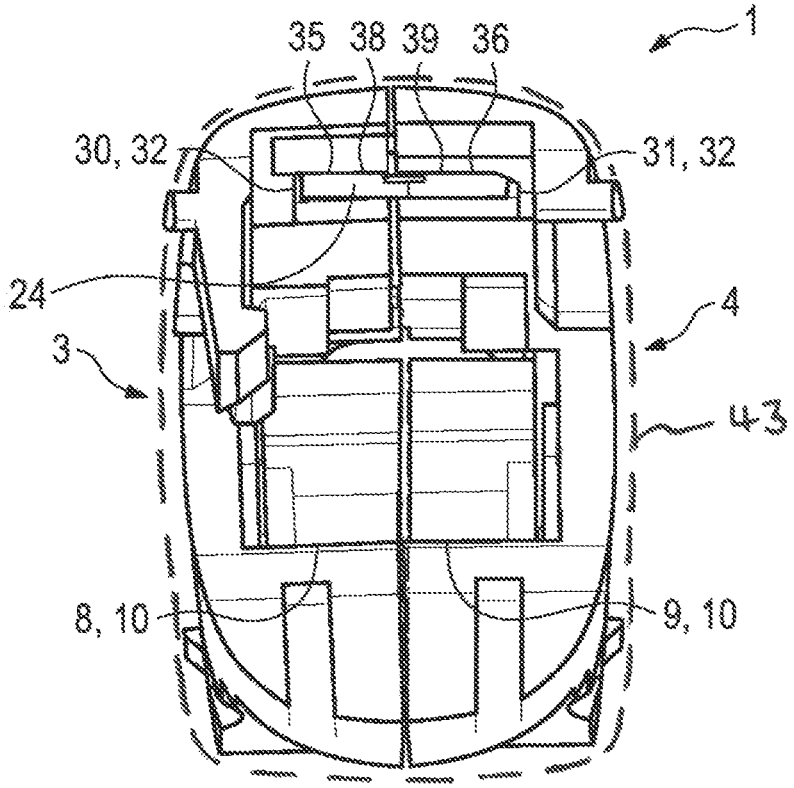
FIG. 3 shows a perspective view of the frame assembled with the aid of the connecting clip and inserted into a housing of the hearing device.

FIG. 3 shows the frame 1 in the state assembled and connected by the back 24 of the connecting clip 20. FIG. 3 furthermore diagrammatically shows the housing shell of a housing 43 of the hearing device, the frame 1 being inserted into the housing shell.

In order to disassemble the frame 1 (for example in order to repair or exchange the retained hearing device components), the connecting clip 20 is simply pulled out of the clip seat 32 counter to the mounting direction 42 (optionally with the aid of a tool), in such a way that the frame parts 3, 4 can be taken apart. The frame 1 carrying the RF antenna is not destroyed and it can be reassembled after maintenance work has been carried out on the hearing device components.

Figure 4:
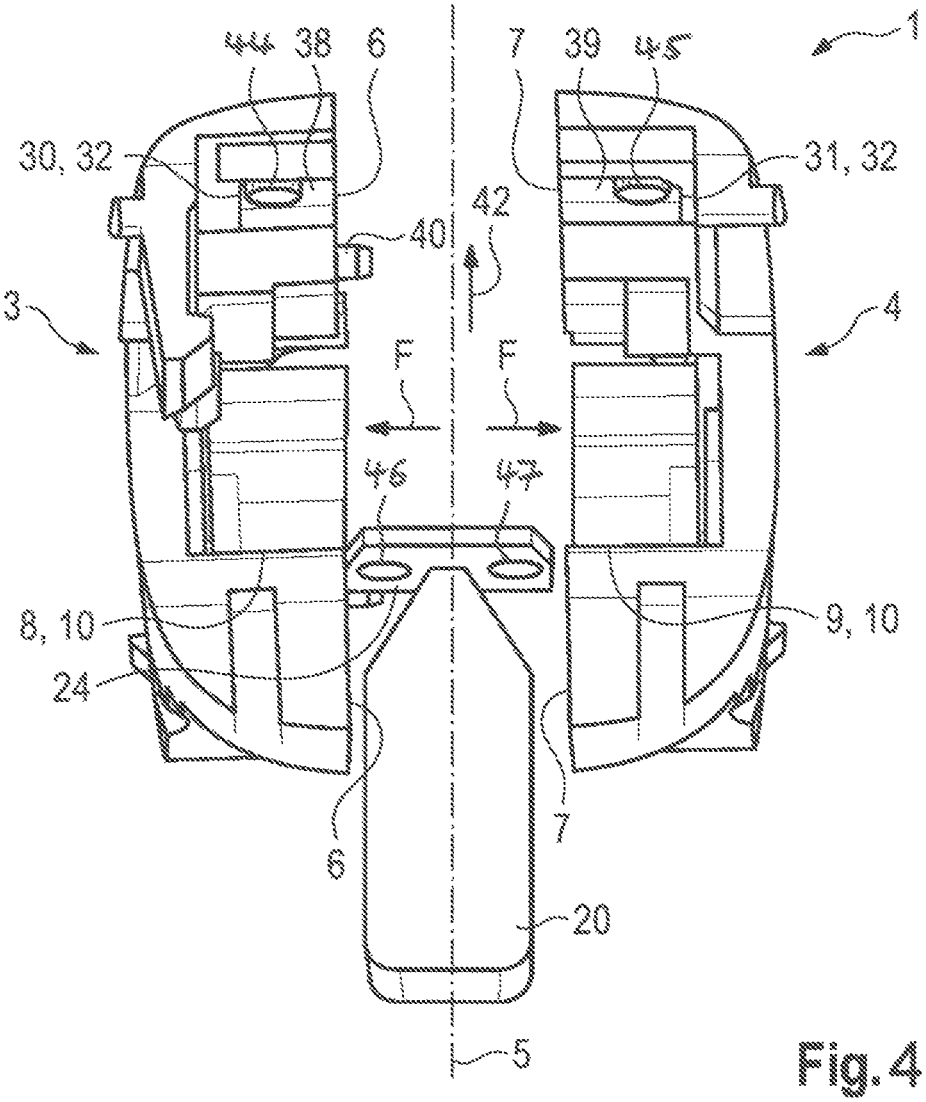
FIG. 4 shows, in representation according to FIG. 1, an alternative embodiment of the frame and of the connecting clip.

FIG. 4 represents an alternative embodiment of the frame 1 and of the connecting clip 20. Here, the frame parts 3 and 4 each include a pin 44 or 45 instead of the recesses 35 and 36. Here, the connecting clip 20 shows two recesses 46 and 47 instead of the pins 26 and 27. In the state, assembled and connected by the back 24 of the connecting clip 20, of the frame 1, the two pins 44 and 45 engage into the corresponding recesses 46 and 47 in the connecting clip 20.

The invention will be particularly clear from the illustrative embodiments described above, but it is not limited to these illustrative embodiments. On the contrary, further embodiments of the invention can be derived from the claims and from the above description.

The following is a summary list of reference numerals and the corresponding structure used in the above description of the invention. List of reference signs:

1 frame
3 frame part
4 frame part
5 partition plane
6 connecting edge
7 connecting edge
8 cutout
9 cutout
10 battery seat
20 connecting clip
22 grip
24 back
25 predetermined breaking point
26 pin
27 pin
28 space
29 front face
30 recess
31 recess
32 clip seat
35 depression
36 depression
38 holding portion
39 holding portion
40 positioning pin
42 mounting direction
43 housing
44 pin
45 pin
46 recess
47 recess
F transverse force

The invention claimed is:

1. A hearing device, comprising:

a housing;

a frame inserted into said housing and retaining hearing device components said frame including two frame parts being joined together or configured to be joined together substantially along a partition plane; and a connecting clip mechanically connecting or configured to mechanically connect said frame parts to each other;

said connecting clip having two mutually spaced apart and mutually parallel pins each engaging into a corresponding recess in a respective one of said frame parts for holding said frame parts together by form-locking engagement transversely relative to said partition plane.

2. The hearing device according to claim 1, wherein said connecting clip includes a back configured as a flat shaped part with a flat side from which said two pins protrude.

3. The hearing device according to claim 1, wherein said frame parts form a seat shaped to complement said connecting clip, and said connecting clip lies in said seat in a mounted state.

4. The hearing device according to claim 1, wherein said connecting clip includes a grip to be separated at a predetermined breaking point during mounting of said connecting clip.

5. The hearing device according to claim 1, wherein said connecting clip is formed of plastic.

6. The hearing device according to claim 1, wherein at least one of said frame parts has an integrated conductor structure.

7. The hearing device according to claim 6, wherein said at least one frame part is an MID part.

8. The hearing device according to claim 1, wherein at least one of said frame parts has an integrated RF antenna.

9. A connecting clip for a hearing device according to claim 1.

10. A hearing device, comprising:

a housing;

a frame inserted into said housing and retaining hearing device components;

said frame including two frame parts being joined together or configured to be joined together substantially along a partition plane; and a connecting clip mechanically connecting or configured to mechanically connect said frame parts to each other;

said frame parts each having a pin engaging into a respective corresponding recess in said connecting clip for holding said frame parts together by form-locking engagement transversely relative to said partition plane.

11. The hearing device according to claim 10, wherein said frame parts form a seat shaped to complement said connecting clip, and said connecting clip lies in said seat in a mounted state.

12. The hearing device according to claim 10, wherein said connecting clip includes a grip to be separated at a predetermined breaking point during mounting of said connecting clip.

13. The hearing device according to claim 10, wherein said connecting clip is formed of plastic.

14. The hearing device according to claim 10, wherein at least one of said frame parts has an integrated conductor structure.

15. The hearing device according to claim 14, wherein said at least one frame part is an MID part.

16. The hearing device according to claim 10, wherein at least one of said frame parts has an integrated RF antenna.

17. A connecting clip for a hearing device according to claim 10.

* * * * *